US006951430B2

(12) United States Patent
Fernschild et al.

(10) Patent No.: US 6,951,430 B2
(45) **Date of Patent: *Oct. 4, 2005**

(54) RUCKSACK APPLICATOR DEVICE

(75) Inventors: Hans-Leo Fernschild, Korschenbroich (DE); Heiko Faubel, Wermelskirchen (DE); Karl-Heinz Rogmann, Ratingent (DE); Ulrike Scheuvens, Langenfeld (DE)

(73) Assignee: Ecolab GmbH & Co. oHG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/911,810

(22) Filed: Aug. 4, 2004

(65) Prior Publication Data

US 2005/0019085 A1 Jan. 27, 2005

Related U.S. Application Data

(63) Continuation of application No. 10/407,412, filed on Apr. 4, 2003, now Pat. No. 6,799,916, which is a continuation of application No. 09/936,141, filed on Sep. 7, 2001, now Pat. No. 6,550,998.

(30) Foreign Application Priority Data

Mar. 12, 1999 (DE) ..... 199 11 131
Mar. 3, 2000 (WO) ..... PCT/EP00/01832

(51) Int. Cl.[7] ..... A46B 11/04
(52) U.S. Cl. ..... 401/48; 401/270; 401/276; 401/284
(58) Field of Search ..... 401/48, 268, 270, 401/275, 276, 282, 284

(56) References Cited

U.S. PATENT DOCUMENTS

| | | | |
|---|---|---|---|
| 2,083,039 | A | 6/1937 | Searls |
| 2,187,671 | A | 1/1940 | Suddarth |
| 2,768,401 | A | 10/1956 | Becker et al. |
| 2,990,979 | A | 7/1961 | Harrison et al. |
| 3,862,466 | A | 1/1975 | Jabsen |
| 3,981,596 | A | 9/1976 | Melton |
| 4,152,084 | A | 5/1979 | Melton et al. |
| 4,588,318 | A | 5/1986 | O'Brien et al. |
| 4,863,299 | A | 9/1989 | Osberghaus et al. |

(Continued)

FOREIGN PATENT DOCUMENTS

| | | | |
|---|---|---|---|
| DE | 2932110 | A | 2/1981 |
| DE | 39 05 760 | A1 | 2/1990 |
| EP | 0 461 873 | A2 | 12/1991 |
| FR | 2 639 818 | A | 6/1990 |
| GB | 2 178 303 | A | 2/1987 |

OTHER PUBLICATIONS

U.S. Appl. No. 10/794,429 filed Mar. 5, 2004.

*Primary Examiner*—Justine R. Yu
*Assistant Examiner*—Peter deVore
(74) *Attorney, Agent, or Firm*—Merchant & Gould P.C.

(57) ABSTRACT

The invention relates to a device for applying flowing media to a surface. Said device comprises a container for the media with at least one opening which is located above the surface and can be deaerated and a mopping or applicator device which is attached to a handle. In addition, the device has a flow-regulating hose which can be shut off, for conveying the media form the container by force of gravity to an outlet on the mopping or applicator device. In addition, the device has a portable unit which is worn on the back, comprising supporting and fixing straps and a mounting plate which is fitted to said unit and which has a rapid-action coupling device. The container has a resealable exit opening at one end with a connecting sleeve and a resealable fill opening at the opposite end, in addition to a hose adapter which can be connected to the connecting sleeve of the exit opening. Said adapter has a shut-off device and a rapid-action coupling for the hose with a drip-protection unit.

23 Claims, 6 Drawing Sheets

U.S. PATENT DOCUMENTS

| | | | |
|---|---|---|---|
| 4,971,471 | A | 11/1990 | Sloan |
| 5,050,530 | A | 9/1991 | Studebaker et al. |
| 5,782,991 | A | 7/1998 | van Der Heyden et al. |
| 6,017,163 | A | 1/2000 | Keppers et al. |
| 6,131,233 | A | 10/2000 | Bolton et al. |
| 6,413,002 | B1 | 7/2002 | Delaine, Jr. |
| 6,550,998 | B1 | 4/2003 | Fernschild et al. |
| 6,612,768 | B2 | 9/2003 | Zorzo |
| 6,695,516 | B2 | 2/2004 | DeFields et al. |
| 6,799,916 | B2 | 10/2004 | Fernschild et al. |
| 6,854,912 | B2 | 2/2005 | Dyer et al. |
| 2002/0186996 | A1 | 12/2002 | Miller |
| 2003/0091380 | A1 | 5/2003 | Chase et al. |

RUCKSACK APPLICATOR DEVICE

CROSS REFERENCE TO RELATED APPLICATION

This application is a continuation of application Ser. No. 10/407,412, filed on Apr. 4, 2003, now having U.S. Pat. No. 6,799,916 which is a continuation of application Ser. No. 09/936,141, filed Sep. 7, 2001, now having U.S. Pat. No. 6,550,998 which claims priority to PCT EP 00/0182, filed Mar. 3, 2000, and to Germany Patent Application No. 199111131.6, filed Mar. 12, 1999, which applications are incorporated herein by reference.

The invention relates to a device for applying flowable media to a surface, comprising a ventilatable container, which is arranged above the surface, for the media, with at least one opening, a wiping or applying device mounted at a handle and a duct, which can be regulated for shutting off and allowing throughflow, for the gravitationally-effected conducting of the media from the container to an outlet on or at the wiping or applying device.

In the state of the art, in the case of cleaning and care activities the cleaning, disinfecting or care agent is tipped directly from a corresponding product cask directly onto the preferably smooth, flat or slightly inclined surface, for example the floor. The agent can, however, also be diluted in a container and tipped onto the floor as a diluted solution ready for use. A dispersion coating is briefly described here, by way of example, for the previous procedure.

For the tipping-on the dispersion the worker has to bend deeply in constant succession in order to pour the dispersion onto the floor and has to significantly incline the upper body forwards and at the same time turn in order to uniformly distribute the product. In this procedure only a part area of the surface can be processed until the poured-on quantity has been dealt with. This work is also frequently undertaken by two persons, one of which tips the dispersion onto the respective area to be processed and the other of which uniformly distributes the dispersion. In all cases there is a continual, time-consuming and tiring alternation between the two different working processes. A continuous working, which is an essential precondition for an even quality of the coating, is not possible in that case. In the state of the art applicator devices are known in which the media are placed under pressure in the containers and conducted out of the container. In that case the throughflow quantity and the flow speed is influenced and is reduced in the case of pressure drop in the container, so that a longer term, continuous and uniform working free of start point is not possible.

In the state of the art devices as described in the introduction are also known, for example in DE 39 05 760 A1. In that case the containers are mounted at the handle of the wiping or applying device. It is indeed thereby possible to reduce at least a part of the difficulties of the described procedure. However, the handling of the wiping or applying device is at the same time made quite significantly difficult, as the mounting of the container at the manipulating handle causes very unfavourable and constantly changing centre-of-gravity relationships. Moreover, in the case of this mounting the size and the shape of the container is strongly limited or restricted and the exchange and subsequent filling or refilling of the container is very inconvenient and made difficult, so that the use of commercially available casks is hardly possible or possible only with much difficulty.

The invention is based on the technical problem of so developing the device described in the introduction that the disadvantages are avoided and in simple and economic manner there is created a device enabling a continuous working of largest possible areas.

This problem is solved in that the device described in the introduction comprises equipment, which can be worn on the back, with supporting and fixing straps and a mounting plate, which is fixed thereto, with a quick-action coupling device and the container has at one end a resealable outlet opening with a connecting piece and a resealable filling opening at an opposite end, as well as a hose adapter, which is connectible to the connecting piece of the outlet opening, with a shut-off device and a hose quick-action coupling with a drip protection device.

This device has the advantage that even larger quantities of the flowable media to be applied can be carried by the operator, as its arrangement on the back of the operator does not obstruct or impair the work during application and even larger areas can thereby be processed by an operator continuously and free of start point. Moreover, it is of advantage that the container can be subsequently filled or refilled in simple manner without the hose adapter having to be removed from the outlet opening for that purpose. In addition, in advantageous manner it is possible at the conclusion of a working phase to leave the rest of the unconsumed medium in the container if the outlet opening is closed by a closure lid after removal of the hose adapter.

Two different container types can be used in the proposed device. For this purpose in a special embodiment the container comprises coupling elements which are matched to the quick-action coupling device of the mounting plate. In another embodiment the coupling elements, which are matched to the quick-action coupling device of the mounting plate, are provided at a cask receiver. Commercially available product casks can be inserted into this cask receiver and thus carried on the back of the operator with the assistance of the cask receiver. If the container has the coupling elements, then this is suitable as a universal container into which the appropriate media can be poured from commercially available product casks.

An embodiment in which the hose adapter comprises a closure system, for example a screw or bayonet closure, matched to the connecting piece of the outlet opening is particularly advantageous. With advantage, the closure system is so constructed that it is matched to the closure of commercially available casks, so that the same hose adapter can be placed not only on the outlet opening of the universal container, but also on the outlet opening of the product cask. Advantageously the hose adapter has a ventilating element so that the container does not need a separate venting device for pressure equalisation and the container at the end of the working process and after removal of the hose adapter can be directly closed again by the closure cap in the pressure-equalised state.

In an advantageous embodiment the universal container has a filling opening which in shape and/or size is suitable for the pouring in of the media without a funnel or similar means and is closable by a closure lid. It is thereby possible to refill the medium, after consumption of the quantity originally poured in, without the container having to be exchanged or the hose adapter or the duct having to be removed for conveying the medium to the duct outlet. Since the universal container and cask receptacle both have identical coupling elements matched to the quick-action coupling device of the mounting plate, it is in addition possible to quickly and simply exchange the universal container for a cask receiver with a commercially available product cask, and vice versa.

In a special embodiment the universal container has a filling state marking indicating the filling state for a solvent, for example water, wherein the solvent quantity corresponding to this filling state is to be dimensioned so that it guarantees by a predetermined concentrate quantity the concentration or dilution prescribed and advantageous for the respective medium. It is thereby possible that the operator, for example for water-soluble concentrate, has to carry only the appropriate concentrate basic quantity in a dosage cartridge or other such dosage container and can then prepare a new container charge in the desired concentration at each water connection point present at the property to be treated. If the refill cartridge or other dosage container has a special closure, a special connecting device for this closure is conveniently provided in the closure cover of the filling opening.

So that the product or medium, on outflow from the duct outlet does not spray at too great a drop height or clash with the wiping or applying device at too small a spacing from the surface to be treated, the outlet opening is arranged above the surface at a spacing matched to the product or medium and the consistency thereof.

The metering valve for throughflow regulation of the product is advantageously arranged between hose quick-action coupling and the outlet of the duct on or at the wiping or applying device, so that after removal of the duct or the hose from the hose adapter the quantity disposed in the duct can still be applied at the desired throughflow rate. In that case it is advantageous if the hose quick-action coupling has a drip protection, which closes the connection to the container in, for example, spring-loaded manner or by a ball or other such, so that even without actuation of the shut-off device no product can continue to flow out of the container after removal of the hose and/or the duct.

The proposed device enables a simple and ergonomically favourable handling for a widespread spectrum of use with high area performance and low consumption of product/media. Product loss is largely avoided, as commercially available product casks can be used and in the case of cask exchange or cleaning of the device only small product residues (waste) occur, since the product residues can usually remain in the closed cask.

The described and further advantages are illustratively clarified in the description of embodiments, which are illustrated in the accompanying drawing, in which.

Figure 1:
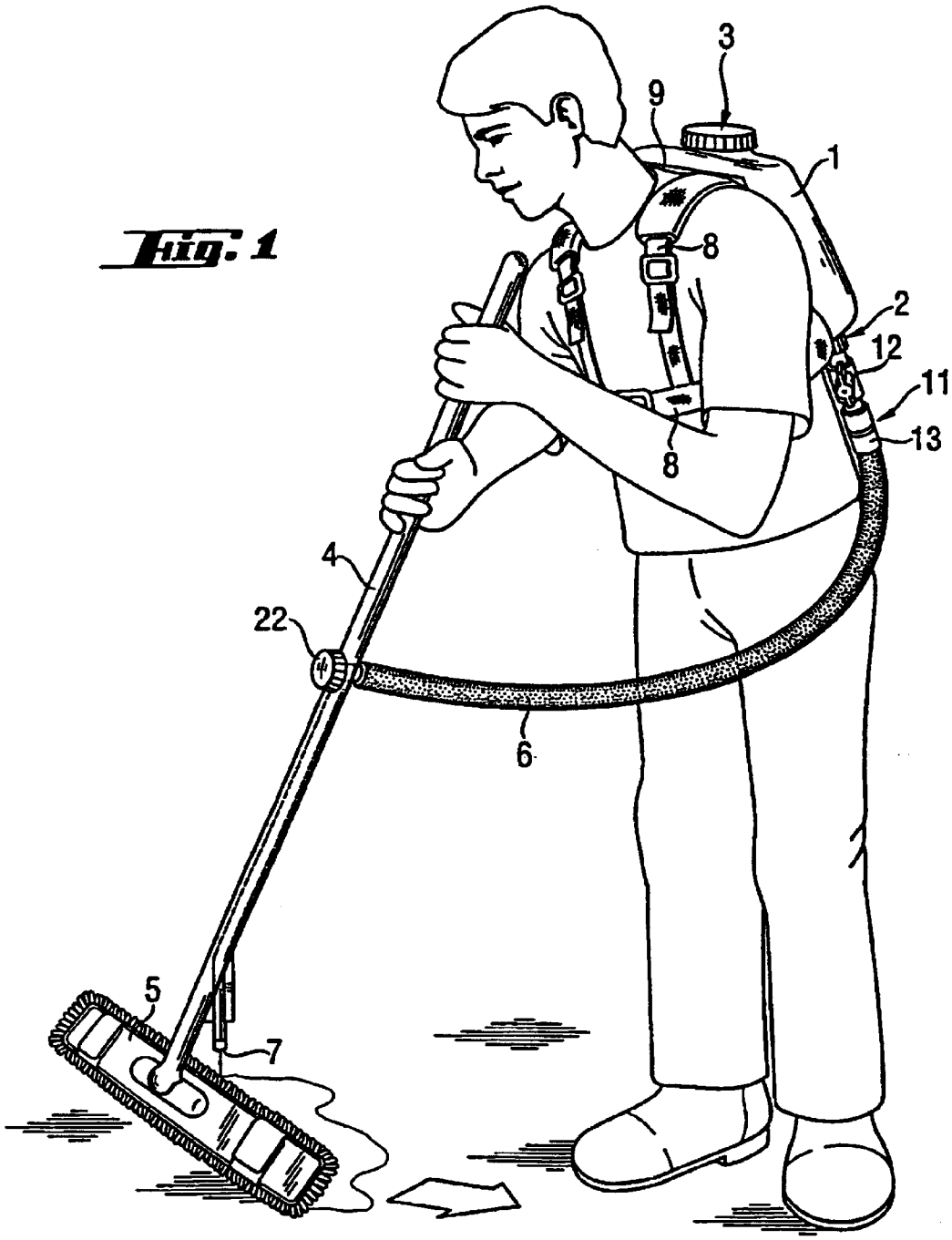
FIG. 1 shows an operator in the case of handling a device according to the invention.

In FIG. 1 there is illustrated an operator actuating a device according to the invention. In that case the operator wears, in equipment worn on the back with supporting and fixing straps 8, a mounting plate 9 which is fixed thereto and to which a container is coupled. Clearly recognisable at the upper end of the container 1 is a filling opening 3 and at the lower end an outlet opening 2, to the connecting piece of which a hose adapter 11 is connected. A duct/hose 6 leads from the hose adapter 11 to a metering valve 22 which is mounted at the manipulating handle 4 and by which the throughflow of the product/medium can be regulated. From the metering valve 22 the duct runs along the handle 4 to an outlet opening 7 arranged above the floor. A wiping or applying device 5 is fastened to the handle 4. The product exits from the outlet opening 7 and is coated on the floor from a defined height near the wiping or coating device 5 and then distributed by the wiping or coating device 5.

Figure 2:
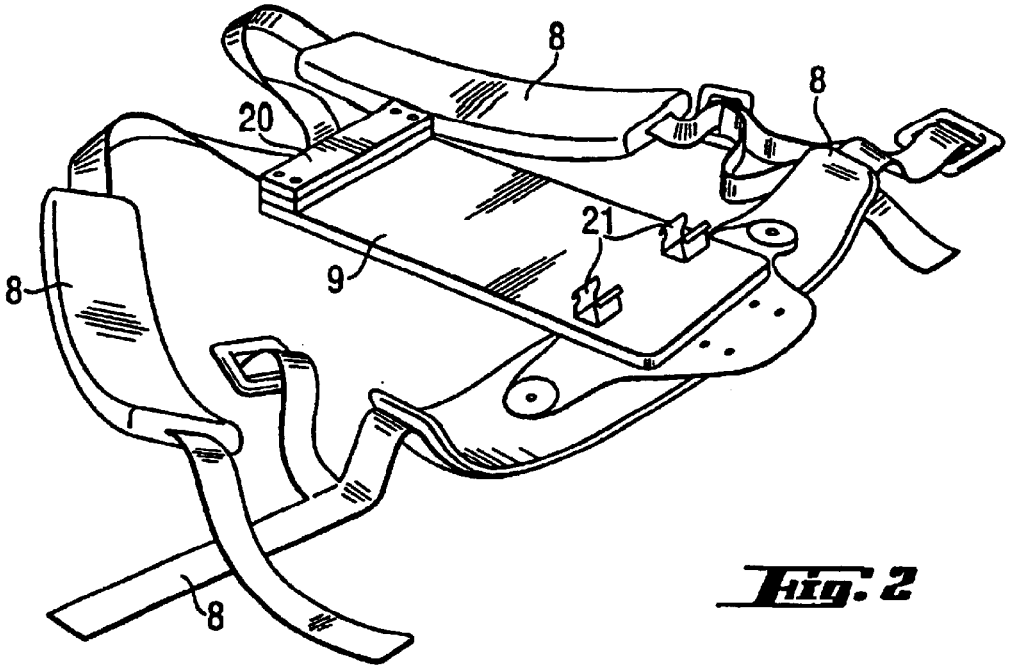
FIG. 2 shows a device worn on the back.
Figure 3:
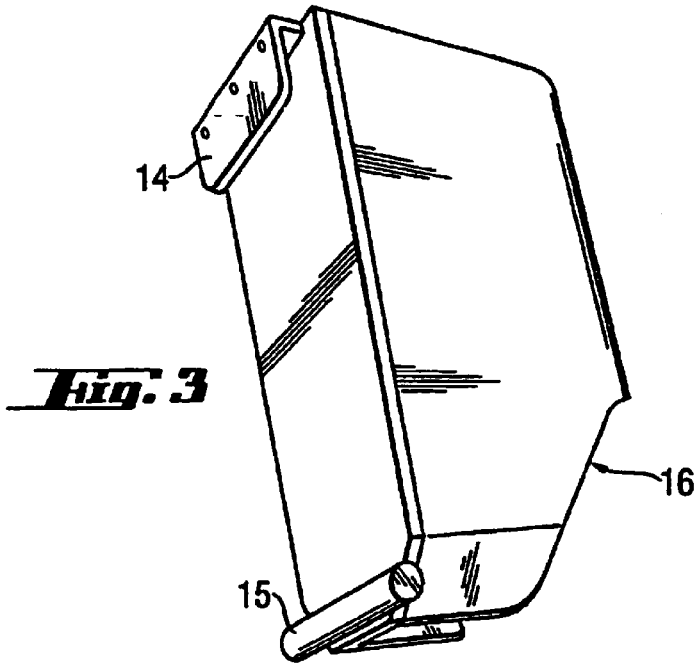
FIG. 3 shows a cask receptacle with coupling elements.

In FIG. 2 there is illustrated equipment worn on the back and consisting of supporting and fixing straps 8 and a mounting plate 9 which is fixed thereto and on which a hook-in element 20 and a clamping element 21 are fastened, these forming the quick-action coupling device. In FIG. 3 there is illustrated a cask receiver 16 with a clip element 14 and plug element 15 which are mounted thereon and form the coupling elements by which the cask receptacle 16 is coupled to the mounting plate 9.

Figure 4:
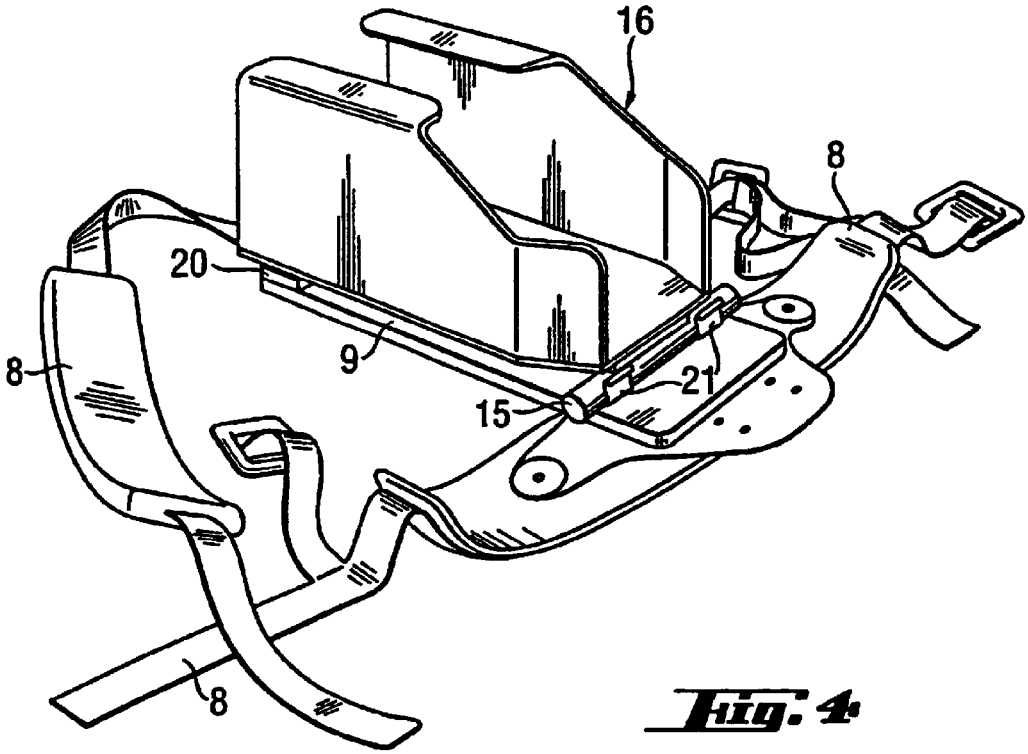
FIG. 4 shows equipment, which is worn on the back, with a coupled-on cask receiver.

Equipment, which is worn on the back, with supporting and fixing straps 8, a mounting plate 9 fixed thereto and a cask receptacle 16 coupled thereto, is illustrated in FIG. 4. In that case the hook-in element 20 is plugged into the clip element 14 in such a manner that it is fixed therein. The plug element 15 is plugged into the clamping element 21, so that the cask receiver 16 is firmly coupled to the mounting plate. The cask receiver 16 has in the mounted position, at the lower end, a constriction by which a product cask/container 1 is securely held as is clearly illustrated in FIG. 5.

Figure 5:
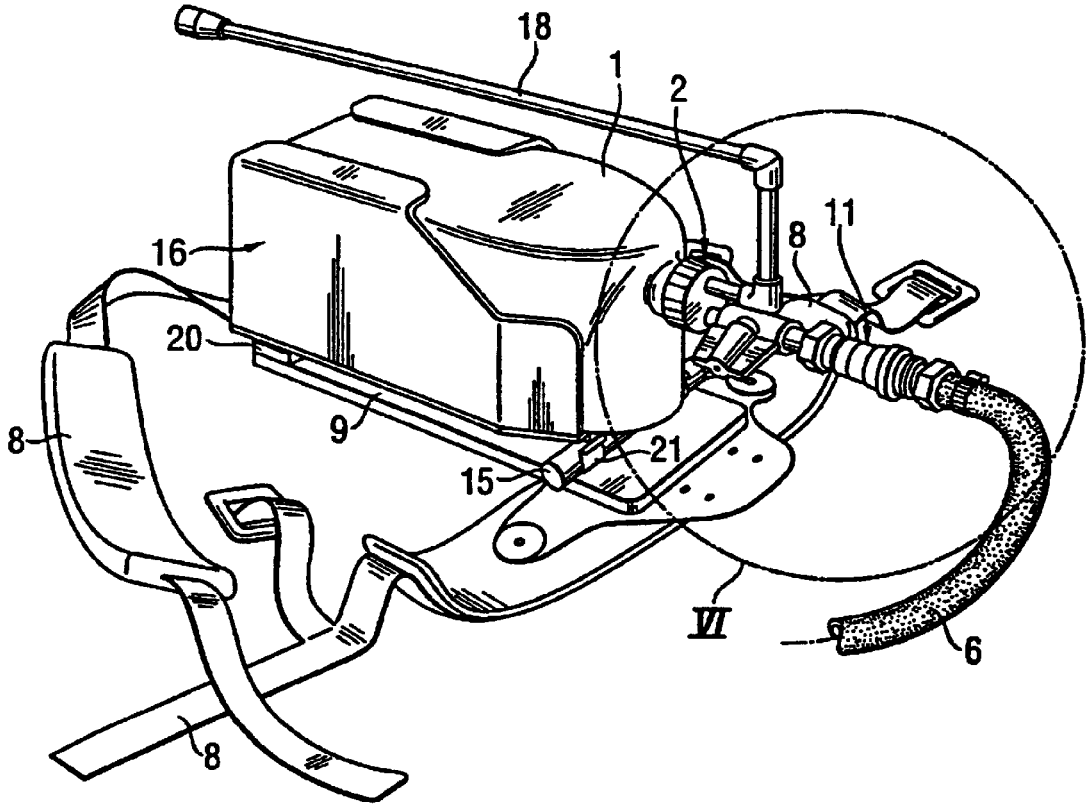
FIG. 5 shows equipment, which is worn on the back, with a coupled-on cask receiver and a product cask inserted therein.
Figure 6:
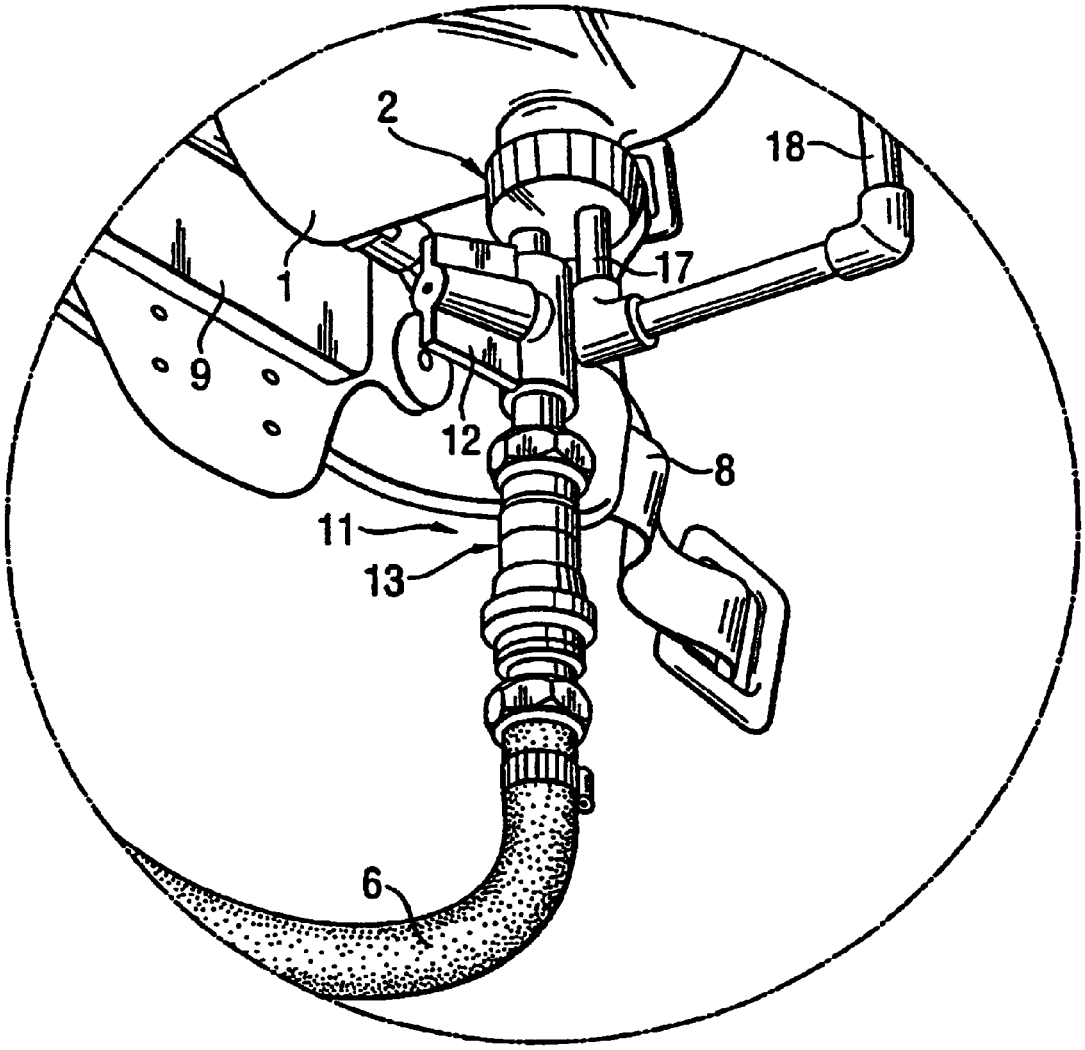
FIG. 6 shows a hose adapter, which is connected to the outlet opening of the container, according to the detail IV in FIG. 5.

In FIG. 5 there is illustrated the fitted-out equipment, which is worn on the back, with a product cask/container 1, which is inserted into the cask receiver 16 and to the outlet opening of which is connected a hose adapter 11. The detail VI is illustrated to enlarged scale in FIG. 6, wherein it can be clearly recognised that a hose adapter 11 is arranged on the connecting piece of the outlet opening 2 of the container 1. The hose adapter 11 has a shut-off device 12 and a hose quick-action coupling 13 thereunder, whereby a hose/duct 6 can be rapidly, simply and securely connected to the container 1. Arranged in the hose adapter 11 is a ventilating element 17, which is connected with a pipe 18 led outside the container to above the uppermost point thereof, the upper pipe end, which is open to the atmosphere, being secured by a one-way element against outflow.

Figure 7:
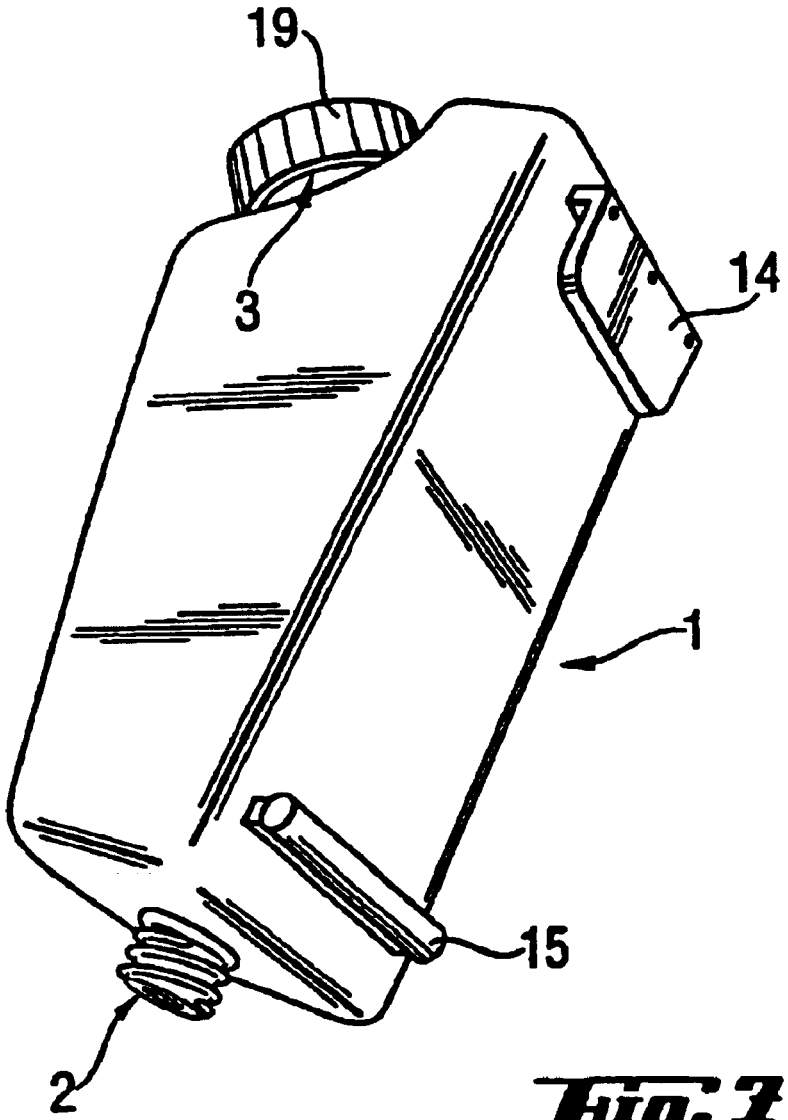
FIG. 7 shows a universal container with coupling elements, in perspective illustration.

In FIG. 7 there is illustrated a universal container 1 in perspective view obliquely from below, so that the outlet opening 2 with the threaded connecting piece as well as the filling opening 3 arranged at the opposite end can be clearly recognised, the opening 3 being closed by a closure lid. Also able to be readily recognised are the coupling elements fastened to the universal container, namely the clip element 14 and the plug element 15. These are constructed in the same manner as already illustrated and described further above for the cask receiver 16. Thus it is possible to couple both the universal container 1 and alternatively the product cask 16 with a handle to the mounting plate 9 and in case of need to exchange the universal container against a product cask/container 1 arranged in a cask receiver 16, and vice versa. Thus a high degree of flexibility in use of the device is given.

Reference Numeral List

1 container
2 outlet opening
3 filling opening

4 handle
5 wiping or applying device
6 duct/hose
7 outlet
8 fixing or retaining strap
9 mounting plate
11 hose adapter
12 shut-off device
13 hose quick-action coupling
14 clip element
15 plug element
16 cask receiver
17 ventilating element
18 ventilating pipe
19 closure cover/filling opening
20 hook-in element
21 clamping element
22 metering valve
23 closure cover/outlet opening

What is claimed is:

1. A device for applying a flowable medium to a surface, comprising:

container, handle, wiping or applying device, duct, outlet, and metering valve;

the container configured to support flowable medium above the surface and to be worn, the container comprising an outlet opening and a filling opening;

the outlet opening configured to release the flowable medium;

the outlet opening configured to allow fluid flow when the container is coupled to the duct and to stop fluid flow when the container is not coupled to the duct;

the filling opening configured for filling the container with the flowable medium;

the handle comprising an end, the wiping or applying device mounted at the end of the handle, the outlet being proximal the end of the handle;

the duct being configured to conduct medium from the container to the outlet;

the metering valve configured to regulate flow of medium from the container through the duct, and to the outlet.

2. The device of claim 1, wherein the filling opening is configured for pouring the flowable medium into the container without a funnel.

3. The device of claim 1, wherein the container further comprises a closure lid configured for closing the filling opening.

4. The device of claim 1, wherein the filling opening is at an upper end of the container.

5. The device of claim 1, further comprising flowable medium in the container.

6. The device of claim 5, wherein the flowable medium comprises water.

7. The device of claim 5, wherein the flowable medium comprises cleaning agent.

8. The device of claim 5, wherein the flowable medium comprises disinfecting agent.

9. The device of claim 1, comprising rigid container.

10. The device of claim 1, wherein the outlet is positioned to release the flowable medium between the operator and the wiping or applying device.

11. A device for applying a flowable medium to a surface, comprising:

container, handle, wiping or applying device, duct, outlet, and metering valve;

the container configured to support flowable medium above the surface and to be worn, the container comprising an opening configured to release the flowable medium and for filling the container with flowable medium; the opening being configured to allow fluid flow when the container is coupled to the duct and to stop fluid flow when the container is not coupled to the duct;

the handle comprising an end, the wiping or applying device mounted at the end of the handle, the outlet being proximal the end of the handle;

the duct being configured to conduct medium from the container to the outlet;

the metering valve configured to regulate flow of medium from the container through the duct, and to the outlet.

12. The device of claim 11, wherein the opening is configured for pouring the flowable medium into the container without a funnel.

13. The device of claim 11, further comprising flowable medium in the container.

14. The device of claim 13, wherein the flowable medium comprises water.

15. The device of claim 13, wherein the flowable medium comprises cleaning agent.

16. The device of claim 13, wherein the flowable medium comprises disinfecting agent.

17. The device of claim 11, comprising rigid container.

18. A device for applying a flowable medium to a surface, comprising:

container, handle, wiping or applying device, duct, outlet, metering valve, and flowable medium;

the container configured to support flowable medium above the surface and to be worn, the container comprising an opening configured to release the flowable medium; the opening being configured to allow fluid flow when the container is coupled to the duct and to stop fluid flow when the container is not coupled to the duct;

the handle comprising an end, the wiping or applying device mounted at the end of the handle, the outlet being proximal the end of the handle;

the duct being configured to conduct medium from the container to the outlet;

the metering valve configured to regulate flow of medium from the container through the duct, and to the outlet;

at least a portion of the flowable medium being in the container.

19. The device of claim 18, wherein the flowable medium comprises water.

20. The device of claim 18, wherein the flowable medium comprises cleaning agent.

21. The device of claim 18, wherein the flowable medium comprises disinfecting agent.

22. The device of claim 18, wherein the container further comprises filling opening.

23. The device of claim 18, comprising rigid container.

* * * * *